US009911321B2

(12) United States Patent
Selfe et al.

(10) Patent No.: US 9,911,321 B2
(45) Date of Patent: Mar. 6, 2018

(54) SIMPLIFIED ADAPTABLE CONTROLLER

(71) Applicant: Logitech Europe S.A., Lausanne (CH)

(72) Inventors: Gareth Selfe, San Francisco, CA (US); Wei Jiang, Fremont, CA (US); Christopher Coley, Morgan Hill, CA (US)

(73) Assignee: Logitech Europe S.A., Lausanne (CH)

( * ) Notice: Subject to any disclaimer, the term of this patent is extended or adjusted under 35 U.S.C. 154(b) by 57 days.

(21) Appl. No.: 15/074,081

(22) Filed: Mar. 18, 2016

(65) Prior Publication Data

US 2016/0307439 A1 Oct. 20, 2016

Related U.S. Application Data

(60) Provisional application No. 62/134,764, filed on Mar. 18, 2015.

(51) Int. Cl.
*G08C 17/02* (2006.01)

(52) U.S. Cl.
CPC ..... *G08C 17/02* (2013.01); *G08C 2201/30* (2013.01)

(58) Field of Classification Search
CPC . G08C 17/02; G08C 2201/30; H04W 88/085; H04W 16/28; H04W 4/00; H04W 4/06; G05B 15/02; H04L 12/282; H04L 12/2805; G06F 13/14; G06F 3/048; G06F 3/041; G06F 3/02; H04N 7/15
See application file for complete search history.

(56) References Cited

U.S. PATENT DOCUMENTS

2005/0096753 A1* 5/2005 Arling ..... G05B 15/02 700/11
2011/0191516 A1* 8/2011 Xiong ..... G06F 13/14 710/305
2013/0278711 A1* 10/2013 Mock ..... H04N 7/15 348/14.03
2014/0249657 A1* 9/2014 Yurasits ..... G05B 15/02 700/90
2015/0036573 A1* 2/2015 Malik ..... H04W 52/0254 370/311

* cited by examiner

*Primary Examiner* — Yong Hang Jiang
(74) *Attorney, Agent, or Firm* — Kilpatrick Townsend & Stockton LLP

(57) ABSTRACT

Systems and methods utilize a smart control hub and a relatively "dumb" remote control device that receives display information from the control hub. The remote control communicates simplified commands that are interpreted by the control hub, and translated into commands that are transmitted by the control hub to devices being controlled. Various display pages, or menus of options, may be fed to the remote control and displayed and/or updated on the remote control. A user can navigate the various pages to control various devices using a limited number of buttons and/or a limited reconfigurable input surface. The pages may be updated, for example, to reflect current state information for devices, e.g. on/off, percent power, etc., or to change available commands, e.g. alternating between "on" and "off", "pause" and "play", etc.

9 Claims, 9 Drawing Sheets

300

SIMPLIFIED ADAPTABLE CONTROLLER

CROSS REFERENCE TO RELATED APPLICATION

This application claims priority to U.S. Provisional Patent Application. No. 62/134,764 filed Mar. 18, 2015, the entire contents of which are incorporated herein by reference for all purposes.

BACKGROUND OF THE INVENTION

The present invention relates generally to remote control devices and, more specifically, to a simplified remote control that provides significant customization, feedback and utility with minimal processing or other onboard capabilities.

Because of the multiple electronic devices currently available within many homes and businesses today, a "universal remote control" is often utilized to allow for the control of a plurality of electronic devices. Universal remote control devices allow for the control of a plurality of external electronic devices with a single remote control, thereby eliminating the need to have a plurality of remote controls physically present within a room. Traditionally, universal remote controls have used "selector buttons" that are associated with specific electronic device to be controlled by the remote control (e.g. television, VCR, DVD player, stereo, etc.) or that associate multiple devices with a certain activity, and which can change the programmed commands associated with specific buttons of the remote control. For example, a remote control may have a selector button that transitions between a TV control mode and a stereo control mode, whereby a "volume" control on the remote control sends stored volume commands recognizable by a particular television in TV control mode, and sends different stored volume commands recognizable by a particular A/V receiver in stereo control mode.

Conventional universal remote controls are typically programmed using two methods: (1) entering an "identifier code" directly into the remote control, or (2) sampling the control signal transmitted by another remote control device. Neither method of programming a universal remote control is efficient and, therefore, many consumers either choose not to purchase a universal remote control or abandon the usage of an already purchased remote control.

There are also other problems with conventional universal remote controls that make them less desirable for consumers. For example, many universal remote controls have a large number of buttons, many of which may never be used, since the manufacturers attempt to have physical buttons for each possible command of each possible electronic device. Additionally, even when large numbers of buttons are included in the remote, the programming and compatibility of the remote with new devices are often limited.

Another problem with conventional universal remote controls is that the electronic components within these devices are relatively complex and expensive to manufacture, resulting in an increased cost to the consumer. This is also true, to an extent, with more recent universal remote controls that include displays and programmable interfaces, which may also require more power to run the onboard customizable applications.

While these devices may be suitable for the particular purpose to which they are addressed, from the combined perspectives of cost, ease of use, efficiency and expandability, they are not optimal. Accordingly, there exist ongoing needs to provide remote control systems that can be applied to multiple devices in a more cost-effective, power-efficient, intuitive and expandable manner.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

According to first aspects of the invention, a remote control system architecture is provided in which a relatively "smart controller," which may be embodied as a stand-alone product and/or as an application running on a smartphone, tablet computer, home PC, etc., is able to configure, provide an interface (both dynamic and static), and provide commands to and receive commands from a relatively "simple controller." In some examples, an display provided on a display surface of the simple controller may be customizable by the user, and may allow the user to understand, for example, what action will be triggered by fixed functions (such as hard buttons) of the simplified controller once the user executes a command, what the relevant state of one or more controlled devices is, whether commands have been received and executed, as well as various other elements of useful information.

In embodiments, the transport mechanism between the smart controller and the simple controller can be various RF technologies and is power efficient in the case where the simple controller is battery powered. In embodiments, the state of various surfaces between the smart controller and simplified controller can be maintained (or between multiple simple controllers and multiple smart controllers). Multiple simple controllers can be "paired" to one or more smart controllers. In embodiments, the smart controller and the simplified controller(s) can be made by different manufacturers e.g. with different proprietary communication formats, such that a smart controller may be configured to operate with different format simplified controller(s) or vice versa.

The smart controller may take many forms and may be embodied in devices like a gateway, a mobile device, Wi-Fi enabled device a Bluetooth device, etc. In embodiments, the smart controller may have more powerful computing power than the simple controller, and may be configured, for example, to access the Internet via Wi-Fi transport and perform higher level computations in a timely manner and contain a secondary low energy transport to communicate to the simple controller. In embodiments, the smart controller may also contain only one RF transport which is used to update the simple controller. The smart controller may have higher power consumption than the simple controller and may be a powered device, or in the case of a battery powered device have a battery of sufficient capacity or be rechargeable.

In embodiments, the architecture may be highly scalable from a simple device supporting just one command to a simple device supporting basically unlimited commands.

According to further aspects of the invention, a remote control system may be provided including a control configuration and command unit, and a communication apparatus configured to interact with one or more simplified remote controls and to communicate with one or more controllable devices. In embodiments, the communication apparatus may include any interface for communicating with another device, including wired and/or wireless communication capabilities, such as Wi-Fi, BlueTooth, IR, Ethernet, and other capabilities. The control configuration and command unit may also support various web-streaming and web browsing modes and, generally, may receive information over a physical wire, fiber optic cable, wirelessly, and/or otherwise.

In embodiments, the control configuration and command unit may be further configured to change the selectable commands of the one or more simplified remote controls based on a current mode of operation of a display or other device, e.g. tuner, AV, HDMI, S-Video, web-streaming, and web browsing modes.

In embodiments, the control configuration and command may include one or more of a device selection interface configured to allow a user to designate one or more devices to be controlled via the control configuration and command unit; a remote control configuration interface configured to allow a user to select remote control options for the at least one simplified remote control, wherein the remote control options include display instructions for the at least one simplified remote control and at least one set of commands for a designated device; a communication device configured to transmit a first set of command codes to the at least one simplified remote control in order to implement the selected remote control options on the simplified remote control, and to receive a second set of command codes from the at least one simplified remote control; and/or a processor configured to associate the second set of command codes with the at least one set of commands and to generate signals for controlling the designated device based at least in part on the association of the second set of command codes and the at least one set of commands.

In embodiments, the simplified remote control may include one or more of a reconfigurable input device including a display that changes based at least in part on the first set of command codes; a communication device configured to receive the first set of command codes from the control configuration and command unit, and to transmit the second set of command codes to the control configuration and command unit; and/or a processor configured to generate the second set of command codes based on at least one of static button identification information, or a combination of static button identification information and page identifier information.

In embodiments, the remote control may be configured to communicate only with the control configuration and command unit, and not any of the designated devices being controlled.

In embodiments, the remote control system may be configured to allow control of the designated device via the remote control without any control codes that are recognizable by the designated device being stored on the remote control.

In embodiments, the control configuration and command unit may be configured to generate a third set of command codes including indicia that the second set of command codes has been implemented, and to send the third set of command codes to the remote control. In embodiments, the remote control may be configured to receive the third set of command codes and to provide feedback to a user of the remote control based at least in part on the received third set of command codes.

In embodiments, a reconfigurable input device may include a plurality of buttons and a plurality of display pages, and the second set of command codes may include indicia of a selected button and currently displayed display page. In some examples, the control configuration and command unit may be configured to identify at least one command for the designated device based on the indicia of the selected button and currently displayed display page.

In embodiments, the indicia of the currently displayed display page may include at least one of a page identifier or a series of navigation commands.

In embodiments, the second set of command codes may include only static button identification information.

In embodiments, the control configuration and command unit may be configured to determine a command based at least in part on a series of static button inputs.

In embodiments, the control configuration and command unit may be configured to send display information for a plurality of display pages to the at least one simplified remote control, and the at least one simplified remote control may be configured to separately display each of the plurality of display pages, and to include indicia of a selected button and currently displayed display page in the second set of command codes.

According to further aspects of the invention, computer-implemented methods and/or computer-readable storage medium may be provided including executable code for configuring a computer processor to perform any of the processes described herein.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

For a fuller understanding of the nature and advantages of the present invention, reference should be made to the ensuing detailed description and accompanying drawings.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced. In the drawings.

DETAILED DESCRIPTION OF THE INVENTION

Figure 1:
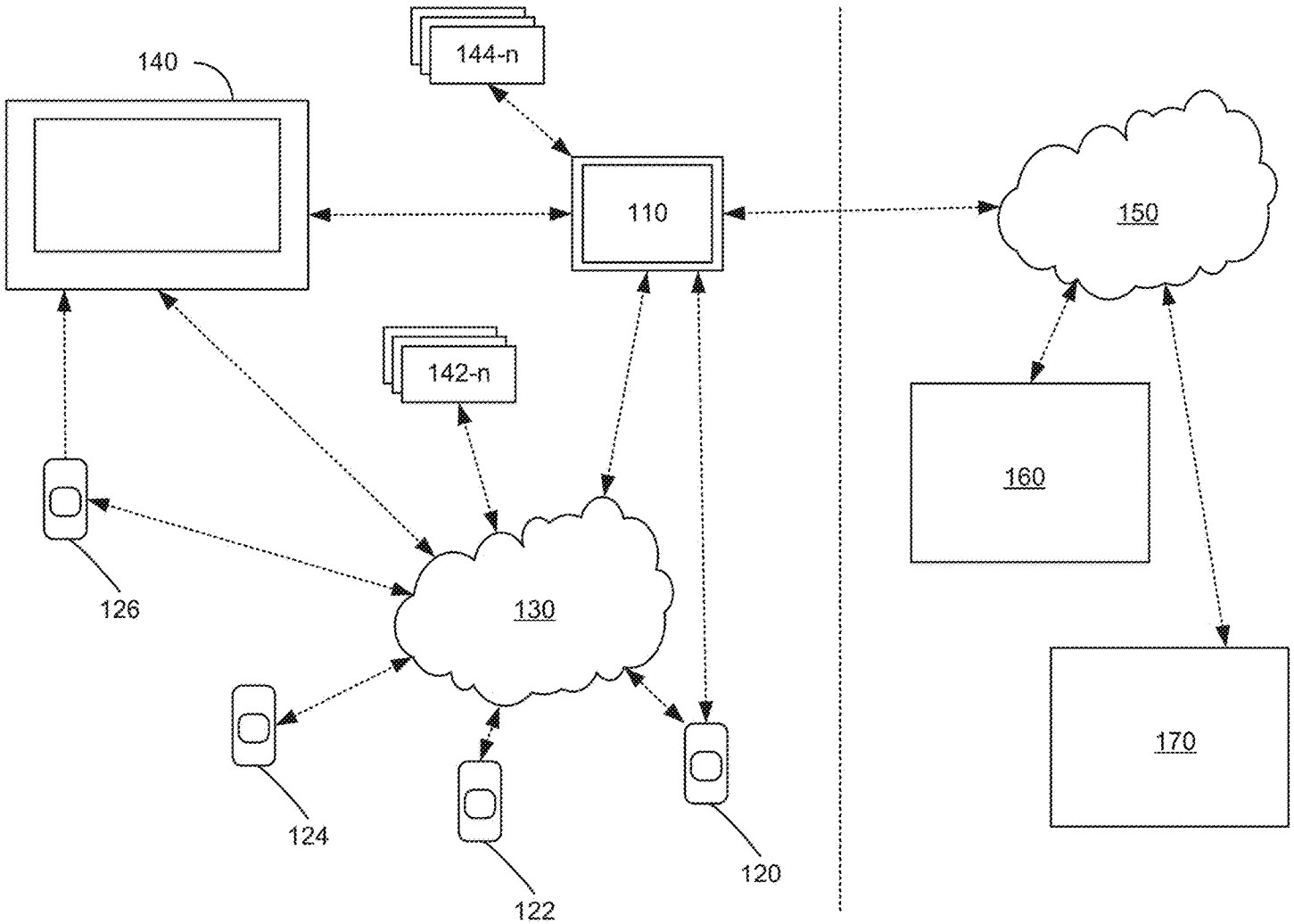
FIG. 1 is a schematic depiction of an exemplary display system and related devices in accordance with at least one embodiment.

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a controller" is a reference to one or more controller and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

The present invention may be used to control and operate various electronic devices including but not limited to televisions, electronic games, stereos, receivers, VCRs, DVD players, CD players, amplifiers, equalizers, tape players, cable units, satellite dish receivers, lighting, window shades and other electronic devices, as well as computer applications running on single purpose or general purpose computers and other electronic devices such as those previously mentioned. Almost any number of external devices may be controlled by the present invention as can be accomplished with conventional remote control devices.

FIG. 1 is a schematic depiction of an remote control system and related devices/environment in accordance with at least one embodiment. As shown in FIG. 1, a remote control system may include a control configuration and command unit 110, and at least one simplified remote control 120-124. In some examples, the control configuration and command unit 110 may include a device selection interface configured to allow a user to designate one or more devices, e.g. 140, 142-*n*, 144-*n*, to be controlled via the control configuration and command unit 100.

A remote control configuration interface run on the configuration and command unit 100, and/or on an associated device, may be configured to allow a user to select remote control options for one or more of the simplified remote control 120-124. In some examples, the remote control options may include display instructions for simplified remote control(s) 120-124 and a set of commands for one or more of the devices 140, 142-*n*, 144-*n*. A device selection interface may also be run on the configuration and command unit 100, and/or on an associated device, that is configured to allow a user to designate one or more of the devices 140, 142-*n*, 144-*n* to be controlled via the control configuration and command unit 110.

Control configuration and command unit 110 may include a communication device configured to transmit a first set of command codes to simplified remote control(s) in order to implement selected remote control options on the simplified remote control, and to receive a second set of command codes from the simplified remote controls. For example, the first set of command codes may include instructions for one or more display screens, that inform the user of changes in the processing performed by the control configuration and command unit 110 based on predetermined command codes provided by the simplified remote control, e.g. a mapping associated with a limited number of commands supported by the simplified remote control.

Control configuration and command unit 110 may also include one or more processors configured to associate the second set of command codes with a set of commands for one or more of devices 140, 142-*n*, 144-*n* and to generate signals for controlling the device(s) based on the association of the second set of command codes and the set of commands. For example, the simplified remote controllers 120-124 may only be capable of transmitting a limited number of command codes that the control configuration and command unit 110 is configured to interpret in virtually limitless ways, by associating the second set of command codes provided by the simplified remote control with any number of device-specific commands.

A display device 140 may include, for example, a display screen, various external controls, a microprocessor, random access memory (RAM), read only memory (ROM), one or more speakers, a data bus, and one or more communications ports and/or devices for receiving and/or transmitting signals such as, for example, IR receivers/transceivers, RF receivers/transceivers, network communication modems, HDMI interfaces, Ethernet ports, USB ports, etc. Various ways of incorporating such components in a display device are known by those of skill in the art and are not exhaustively described herein.

The display device 140 may be, for example, a TV configured to receive commands, e.g. via IR signals and the like, from controller 126 or from control configuration and command unit 110.

The simplified controller(s) 120-124 may take various forms, for example, from a relatively simple remote control with a programmable display, and a limited number of static buttons. In preferred embodiments, the controller(s) 120-124 are configured to have their display characteristics set based on communications received from control configuration and command unit 110. In some examples, the display characteristics may include a plurality of different display pages associated with different devices, commands, activities, applications, etc.

According to aspects of the invention in accordance with at least one embodiment, a relatively simple and inexpensive remote control(s) 120-124 may be used by offloading significant portions of the programming and information related to the variety of command functions for myriad external devices from the remote control(s) 120-124 to the control configuration and command unit 110. For example, the remote control 120 may be one designed for use only with the control configuration and command unit 110, i.e. not a "universal" remote, and may have limited onboard programmable functionality, e.g. related to displayable content. In some embodiments, the remote(s) 120-124 may be permanently configured to transmit only a limited number of command signals, which may be associated with specific hard buttons and/or display page identifiers.

The control configuration and command unit 110 may include a network interface to send and receive data over a network 130 connected to other electronic systems. The control configuration and command unit 110 may also include a USB or other connector to connect to myriad peripheral devices, such as mice, modems, keyboards, storage devices, etc. An interface card or similar device and appropriate software implemented by an onboard microprocessor can be utilized to connect the control configuration and command unit 110 to an external network 150 and transfer data according to standard or other protocols including data over a global computer network such as the Internet. The control configuration and command unit 110 may connect to the network 150, which may allow communication with various other databases and/or services such as, for example, video streaming service, web browsing, device software update/activation services, etc., via one or more separate components (e.g., a computer system, etc.), or directly.

The control configuration and command unit 110 may communicate directly or indirectly with various other electronic devices **142-*n* and/or 144-*n*, one example of which may be a smart TV 140. Any number of devices configured to be remotely controlled may also be supported, such as, for example, a DVD or other media player, Audio/Video Receiver (AVR), gaming systems, computer systems and associated applications, home security systems, thermostats or other climate control systems, lighting and/or shading systems, etc. Such communications may be performed by any well-known communication system that allows communications with external electronic devices, e.g. infrared (IR), consumer electronics control (CEC), Internet protocol (IP), unidirectional and/or bi-directional radio frequency (RF), visible light, light outside of the visible spectrum, ultrasonic, and various other means. In embodiments, such communications may be performed according to predetermined control protocols for the external devices, e.g. according to remote control and/or controller protocols of the external devices. The control configuration and command unit 110 may be configured to obtain such protocols, for example, from a remote service provider 170 over the network 150, local programming input, a local computer network, direct communication with external devices 144-*n*, indirect communication with devices 142-*n***, and/or receiving a "signal sample" from another remote control.

The control configuration and command unit 110 may include memory and one or more processors that collectively execute instructions stored in the memory. The one or more processors may operate a background application that collects information and performs operations in accordance with the present disclosure. For example, the one or more processors may enable the control configuration and command unit 110 to implement a background application that determines various menus and presents the various menus via display device 140 or other display.

The memory may additionally store various information that allows for various determinations to be made for the presentation of dynamically determined menus in accordance with the various embodiments. For example, the memory may store one or more tables or other data structures that include various information about various devices that are used with the control configuration and command unit 110. In addition, the control configuration and command unit 110 (or other device) may be configured to interact with external devices over several mediums, including, but not limited to, IR, integrated IR, external blaster accessory, IP, CRC over HDMI, IP over home network, RF4Ce, Bluetooth, and the like.

The present invention is well suited for use with a global computer communication network such as the Internet. However it can be appreciated that, as future technologies are created, various aspects of the invention may be practiced with these improved technologies. In addition, various wireless technologies provide a suitable communications medium for operating aspects of the present invention.

According to aspects of the invention, the control configuration and command unit 110 may be configured to provide various menus and UI for the control of external devices such as those shown in FIG. 1, and allow the user to configure various command display pages for simplified remote controls 120-124.

In some examples, simplified remote controls 120-124 may include a reconfigurable input device including a display that changes based at least in part on the first set of command codes. As discussed further herein, some examples of a reconfigurable input device may include a programmable display associated with a set of hard buttons that are configured to activate predetermined signals. A reconfigurable input device may also include the ability to modify the second set of command codes, for example, to include indicia of command screen numbers or other non-command specific indicators that allow the control configuration and command unit 110 to interpret the command, such as combining a code for "screen 2" with another code for "button 1" when button 1 is pressed while screen 2 is displayed. Accordingly, the processor of any of simplified remote controllers 120-124 may be simplified, for example, to generate the second set of command codes based on static button identification information, or a combination of static button identification information and page identifier information. In some examples, the indicia of the currently displayed display page may include a series of navigation commands, e.g. "page forward" and/or "page back" commands that allow the control configuration and command unit 110 is configured to infer what page is being viewed by the user. This may allow, for example, the control configuration and command unit 110 to determine a command based only on a series of static button inputs, without any processing by the simplified remote control, other than the changing display screens.

In some examples, the control configuration and command unit 110 may be configured to send display information for a plurality of display pages to the simplified remote controllers 120-124. Additionally, the simplified remote controllers 120-124 may be configured to separately display each of the plurality of display pages, and to include indicia of a selected button and currently displayed display page in the second set of command codes The remote control system architecture shown in FIG. 1 allows a relatively "smart controller," like the control configuration and command unit 110, which may be embodied as a stand-alone product and/or as an application running on a smartphone, tablet computer, home PC, etc., to configure, provide an interface (both dynamic and static) and provide commands to and receive commands from a relatively "simple controller," like simplified remote controllers 120-124. The interface provided on a display surface of the simplified remote controllers 120-124 may be customizable by the user, and may allow the user to understand, for example, what action will be triggered by the simplified controller once the user executes a command, what the relevant state of one or more controlled devices is, whether commands have been received and executed, as well as various other elements of useful information as discussed further herein.

In embodiments, the transport mechanism between the control configuration and command unit 110 and the simplified remote controllers 120-124 can be various RF technologies and is power efficient in the case where the simplified remote controllers are battery powered. As shown in FIG. 1, this may include direct communication between control configuration and command unit 110 and simplified remote control 120, or may be communicated over a network such as network 130. Likewise, control configuration and command unit 110 may communicate directly with any number of devices **144-*n*, or via network 130 (or 150) with any number of devices 142-*n*. Control configuration and command unit 110 may also be configured to communicate with other databases 160 and/or services 170 via the network 150**, such as the Internet.

In some examples, the control configuration and command unit 110 may also be configured to communicate with and/or maintain state information with another controller 126 which may be, for example, a fully programmable remote control and/or a device-specific remote control. In embodiments, the state of various surfaces between the control configuration and command unit 110 and/or associated programmable remote controllers and simplified remote controllers 120-124 can be maintained, or between multiple simple controllers and multiple smart controllers. Multiple simplified remote controllers 120-124 can be "paired" to one or more smart controllers associated with control configuration and command unit 110. In embodiments, the control configuration and command unit 110 and the simplified remote controllers 120-124 can be made by different manufacturers e.g. with different proprietary communication formats, e.g. a control configuration and command unit 110 may be configured to operate with different format simplified controller(s) or vice versa.

Figure 2:
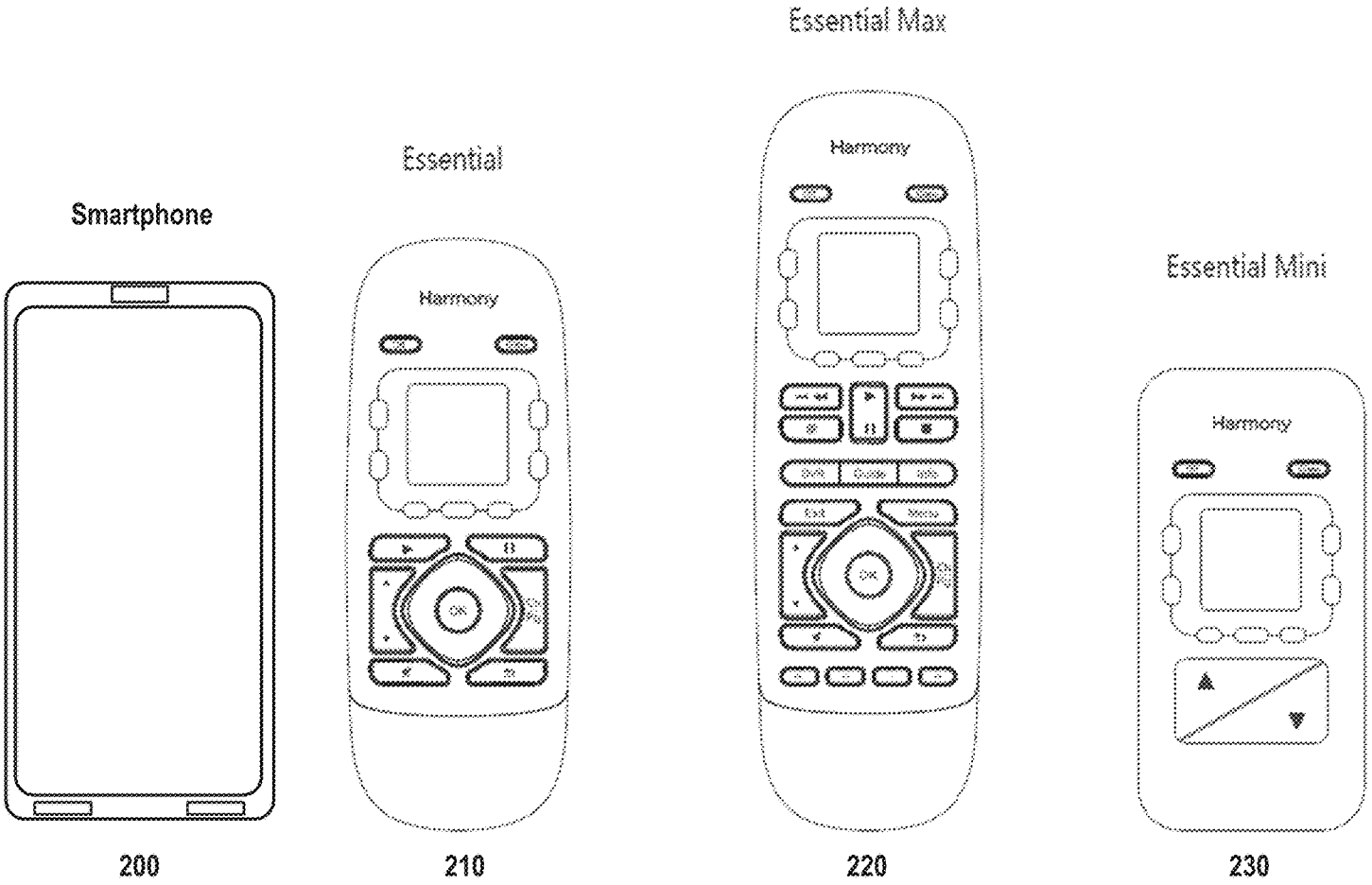
FIG. 2 shows various remote controls that may be used in accordance with at least one embodiment.

The control configuration and command unit 110 may be any number of devices like a gateway, a mobile device, Wi-Fi enabled device a Bluetooth device and so on. In embodiments, the control configuration and command unit 110 may have more powerful computing power, and may be configured, for example, to access the Internet via Wi-Fi transport and perform higher level computations in a timely manner and contain a secondary low energy transport to communicate to the simple controller. As shown in FIG. 2, smart controllers that may be used in conjunction with, or as a platforms for, control configuration and command unit 110 may include smart phone 200, or programmable controllers 210, 220. A simplified remote control may also include a controller 230, e.g. in which a limited number of buttons and a variable display are provided.

Returning to FIG. 1, the control configuration and command unit 110 may also contain only one RF transport which is used to update the simplified remote controllers 120-124. The control configuration and command unit 110 may have higher power consumption than the simplified remote controllers 120-124 and may be a powered device, or in the case of a battery powered device have a battery of sufficient capacity or be rechargeable.

As will be appreciated, the architecture shown in FIG. 1 is highly scalable from a simple device supporting just one command to a simple device supporting basically unlimited commands via interaction with the control configuration and command unit 110.

In embodiments, the control configuration and command unit 110 may be further configured to change the selectable commands of the one or more simplified remote controls 120-124 based on a current mode of operation of a display 140 or other device, e.g. tuner, AV, HDMI, S-Video, web-streaming, and web browsing modes.

In embodiments, the display device 140 may include selectable modes of operation including at least three of tuner, AV, HDMI, S-Video, web-streaming, and web browsing modes. Embodiments may include changing the selectable commands on the simplified remote controls 120-124 based on a current mode of operation of the display device 140 and/or displaying different selectable commands in the UI based on the at least three modes of operation. In embodiments, for example, different selectable commands may be displayed in the user interface based on the at least three modes of operation.

In embodiments, the simplified remote controls 120-124 may be configured to communicate only with the control configuration and command unit 110, and not any of the designated devices being controlled. Similarly, the environment shown in FIG. 1 may be configured to allow control of the devices 140, **142-*n*, 144-*n* via the simplified remote controls 120-124 without any control codes that are recognizable by the devices 140, 142-*n*, 144-*n* being stored on the simplified remote controls 120-124**.

In embodiments, the control configuration and command unit 110 may also be configured to generate a third set of command codes including indicia that the second set of command codes has been implemented, and to send the third set of command codes to the remote control. For example, the third set of command codes may be configured to provide feedback to the user via adaptable display on the simplified remote controls 120-124. In some examples, the third set of command codes may be specifically addressed to one of the simplified remote controls 120-124, e.g. to provide controller-specific feedback, or the third set of command codes may be addressed to more than one of the simplified remote controls 120-124, e.g. to change shared device state information.

In embodiments, the simplified remote controls 120-124 may be configured to receive the third set of command codes and to provide feedback, such as changes to the display on the remote control, to a user of the remote control based on the received third set of command codes, examples of which are discussed further below.

In embodiments, the environment shown in FIG. 1 may be variously configured to generate and/or determine location information for one or more of simplified remote controls 120-124. This may be accomplished, for example, using onboard electronics (e.g. GPS or other locating methods) of the simplified remote controls 120-124, via beacons, near field communication, or communication-based inferences related to simplified remote controls 120-124, etc. In some examples, the control configuration and command unit 110 may be configured to update display/commands for remote controls based on such location information, such as by updating currently available display/commands based on a room in which the simplified remote control is located.

In some embodiments, the control configuration and command unit 110 may be configured to automatically determine whether a designated device is ON or OFF, and to update display/commands for remote controls based on that determination, such as only presenting display/commands for a device that is determined to be ON, or only presenting a limited number of commands such as a "power on" command for such device(s).

In embodiments, the control configuration and command unit 110 may be configured to activate and/or update the display/commands for one or more of the simplified remote controls 120-124 based on automated network communication with a remote database 160 and/or service provider 170. For example, configurations for certain devices may be obtained via a database 160, macros or other commands may be obtained and/or updated from a service provider 170, available content may be updated via service provider 170, etc.

Figure 3:
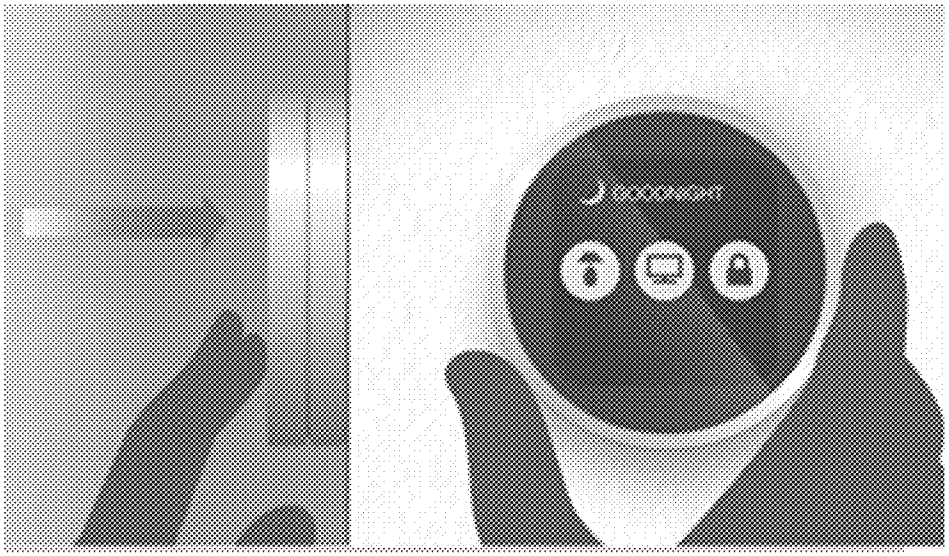
FIG. 3 shows an exemplary simple remote that may be used in accordance with at least one embodiment.

FIG. 3 shows an example of a simplified controller 300 according to further aspects of the invention. As shown in FIG. 3, controller 300 includes a reconfigurable interface with a display, a two-way dial, and at least one press function. In this example, the controller display is loaded with a first command display page showing different devices that can be controlled, e.g. a lamp, a TV, and a door lock. The controller 300 may be configured to highlight a specific one of the devices when activated, and a user can highlight different devices by rotating the dial left or right. The user can select the highlighted device by pressing the controller. Upon selecting one of the devices, a command code may be sent by the simplified controller 300 to a control configuration and command unit, including, for example, codes indicating "page 1", "dial right", and "press button 1" to select the TV. The configuration of the display on controller 300 may be set by the user via the control configuration and command unit, including, for example, what devices are displayed, what order they are in, what is the default highlighted device when the controller 300 is activated, etc. Additional examples are shown in FIGS. 4A-4D.

Figure 4A:
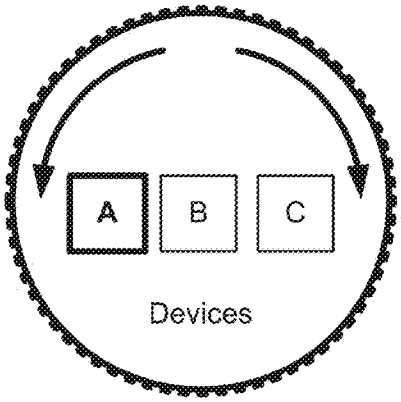
FIGS. 4A-4D show different displays that may be used on an example remote control device in accordance with at least one embodiment.
Figure 4B:
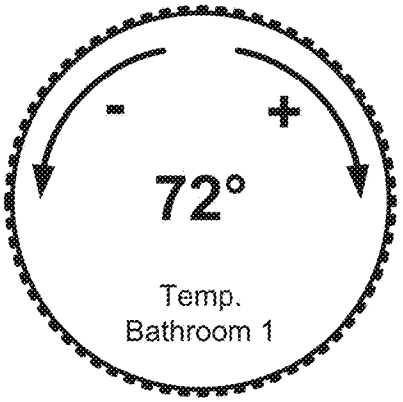

FIGS. 4A-4D show examples of how simplified controller 300 may be modified according to further aspects of the invention. As shown in FIG. 4A, the dial of controller 300 may be used to navigate through devices A-C by rotating left or right. As shown in FIG. 4B, once a device is selected (e.g. by pressing the controller 300), in this case a thermostat, the display of controller 300 may be changed to a second page including indicia of a room, a current temperature setting, and how manipulation of the dial will affect the temperature setting (e.g. left for –, right for +). In some examples, the display of certain information may be changed based on information (e.g. third command codes) received from the control configuration and command unit. For example, an actual temperature setting (or detected temperature) may be communicated back to the controller 300 via updated page display information.

Figure 4C:
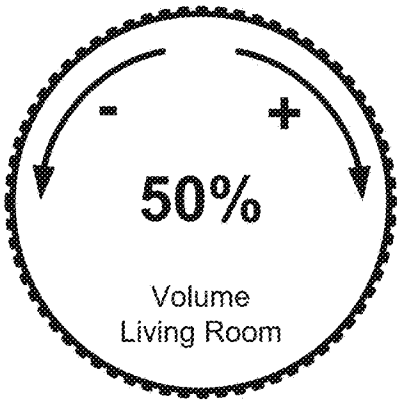

After a predetermined period of time, or other command or setting, the controller 300 may reset the display to that shown in 4A, again allowing selection of devices A-C. As shown in FIG. 4C, selection of device B may bring up a third display page with indicia related to volume level and controlling volume in a specific room. In this case, rotating the dial may cause certain command codes that are the same as those used in FIGS. 4A and 4B (e.g. "dial left" and "dial right" command codes) to be combined with a new page identifier that allows a hub to interpret the specific command that is intended. For example, a "dial left" command in FIG. 4B is added to a "page 2" command code that the hub interprets as "temperature down" for a first device (e.g. room thermostat), whereas a "dial left" command in FIG. 4C is added to a "page 3" command code that the hub interprets as "volume down" for a second device (e.g. a designated amplifier).

Figure 4D:
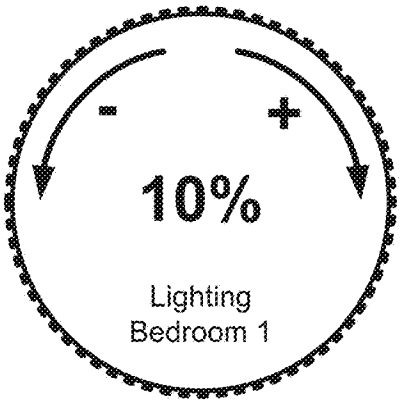

After a predetermined period of time, or other command or setting, the controller 300 may reset the display to that shown in 4A, again allowing selection of devices A-C. As shown in FIG. 4D, selection of device C may bring up a fourth display page with indicia related to lighting level and controlling lighting in a specific room. In this case, rotating the dial may cause certain command codes that are the same as those used in FIGS. 4A-4C (e.g. "dial left" and "dial right" command codes) to be combined with a new page identifier that allows a hub to interpret the specific command that is intended. For example, a "dial left" command in FIG. 4D is added to a "page 4" command code that the hub interprets as "lighting down" for a third device (e.g. one or more lamps in Bedroom 1).

The examples shown in FIGS. 4A-4D represent at least one way of customizing the commands on a simple controller from a smart controller to indicate to the user what command will be triggered by the simple controller to the smart controller, once the user executes the command. In these examples, display codes that the controller 300 may interpret and implement as specific displays like the pages shown in FIGS. 4A-4D may be generated and modified by the hub or control configuration and command unit, and communicated to the controller 300 with minimal processing by the controller 300, thereby making the controller 300 significantly simpler to design, and more power-efficient in operation. In some examples, the second command codes may include actual display data for the command display pages and/or predetermined commands that are associated with limited onboard graphics stored on the controller 300.

In some examples, a user can decide what commands are enabled on the controller 300 via interaction with the control hub. The controller 300 may be configured to only trigger one command or it may be possible for the user to trigger many different commands. The indication of what will be triggered by the controller 300 can take many forms, e.g. text or icons appearing on a display and/or audible/voice cues.

As discussed further herein, commands on the controller 300 can be pre-loaded (e.g. pre-synchronized) or dynamic (e.g. not synchronized).

Dynamic loading of the commands on the controller 300 by the smart controller (e.g. control configuration and command unit 110) may offer significant flexibility, as the smart controller sends the next command or command set to the simple controller after the first command is executed by the user or the user navigates to the next command. In this case, the controller 300 may receive all information that is to be presented to the user from the smart controller and, when the users navigates to the next command or set of commands, the smart controller sends display data regarding what should be presented next to the user.

Pre-loading commands can be used, for example, when the transport mechanism or computing power of the simple controller 300 is not sufficient enough to offer a good user experience due to various reasons. One reason could be that the transport interface does not have sufficient bandwidth to send the commands and therefore the commands are not updated on the simple remote in an acceptable amount of time to offer a good user experience. Pre-loading some commands on the controller 300 can also offer a streamlined experience controlling various devices "out of the box"—with no set-up required.

The commands on the controller 300 can also be a subset of the most popular commands for a specific device. A backend service accessed by the control configuration and command unit 110 may pre-populate what the most popular commands are for a specific device that is registered with the control configuration and command unit 110 by analyzing the customer usage from many user accounts.

Triggering commands on the controller 300 can be done in many ways beyond those shown in FIG. 3, e.g. physical hard buttons, touch enabled soft buttons and voice activated commands.

In embodiments, the simple controller 300 may stay synchronized with control configuration and command unit 110 by:

(a) control configuration and command unit 110 sends all information on what the controller 300 should display and the controller 300 only stores that one screen or command;

(b) the controller 300 stores some pre-loaded screens or commands and sends to the control configuration and command unit 110 the navigation commands through these screens or commands; or (c) the controller 300 stores some pre-loaded screens or commands and sends a combined command signal with the necessary navigation indicia (e.g. the user navigates through 3 screens and then presses button C. The remote would send "3C").

In some examples, RF transmitting time may be reduced by pre-loading at least some display images on the simple remote (so instead of full image data only image indexes need to be transmitted). In some examples, compressed image data can also be used, e.g. to transmit in shorter time, and de-compressed and streamed to the remote display when received by the simple remote without requiring data written to and read from memory.

Combinations of the foregoing synchronization methods may also be used.

In some examples, a "No Sync" configuration may be used, in which the simple controller only receives display information from hub and displays it on LCD when necessary. As such, all smart state coordination and logic may be managed in the hub. In those cases, the simple remote may receive button event acknowledgement from the hub with display information, and the simple remote may update LCD based on received display information.

The simple remote may also be configured to store latest display information for LCD update after rebooting (for example, after changing battery).

In some examples, a "Pre-Sync" configuration may be used, in which the simple remote may check for update status via the hub and download a latest user configuration to local memory when necessary. In such cases, the simple remote may acquire device function and/or activity information from the hub after pairing or rebooting, and may store activity information in memory after acquiring from hub. If an activity key is pressed, the simple remote may check with the hub to determine if its stored activity information is up-to-date. The simple remote may send associated Activity/Device button event to the Hub based on user configuration and swipe event.

The simple controller, like controller 300, can take many forms. One such form is such that the electrical and software architecture minimizes cost and minimizes power consumption. In order to minimize power consumption the simple controller may be kept "asleep" until a command is executed on the simple controller. The simple controller can also be woken up by triggering an onboard proximity sensor or acceleration sensor. The simple controller can also wake itself up on a specific schedule to check for updates from the smart controller.

In the case of a simple controller having a display, the display may be an ultra-low power type in order to support the described functions using a small capacity battery. The backlighting of the display may also be configured to minimize power consumption.

The transport mechanism between the controller 300 and smart controller (such as control configuration and command unit 110) can be a number of different radio frequency transports. In some cases it is beneficial to have a low power standardized transport like ZigBee, Z-Wave or Bluetooth Low Energy (Bluetooth Smart) in order for power consumption on the simple controller to be minimized and support necessary functions with a small capacity battery. By using a standardized RF transport it is possible for the simple controller to interface with products made by various manufacturers directly or via a straightforward application programming interface (API) between the simple controller and smart controller.

In some examples, Bluetooth Low Energy, ZigBee and/or Z-Wave may be used to provide a mesh network that can be used to extend the range between the simple controller and smart controller. A proprietary RF transport may also be used in place of a standardized interface.

Figure 5A:
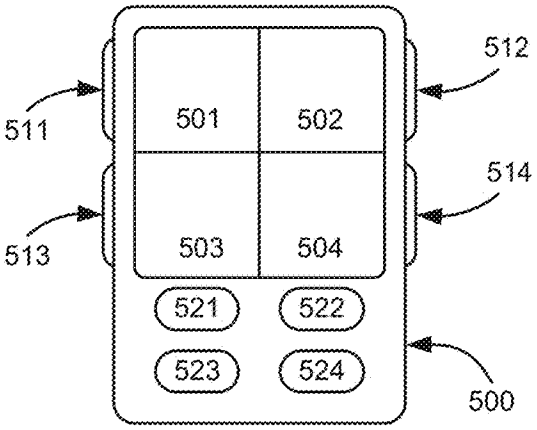
FIGS. 5A-5D show different displays that may be used on another example remote control device in accordance with at least one embodiment.

FIGS. 5A-5D show others examples of how another simplified controller 500 may be modified according to further aspects of the invention. As shown in FIG. 5A, controller 500 may include a display with regions 501-504, hard buttons 511-514 corresponding to display regions 501-504, and additional function buttons 521-524, which may be configured to allow page navigation, controller power, and/or other functions.

The hard buttons 511-514 may be preconfigured to generate a fixed control signal that represents only the button being pushed, i.e. as "fixed function" buttons. As described herein, the display of regions 501-504 may be modified based on different page information provided by a control hub or the like, and the controller 500 may be configured to transmit indicia of the page that is being displayed in order for the control hub, such as the configuration and command unit 100, to interpret the command that is intended by the user. The buttons 521-524 of controller 500 may be used to navigate through devices or display screens, to power the controller 500 on and off, or to send simple navigation and/or select commands to the control hub, e.g. to navigate a menu that is displayed on another device such as display 140. In some examples, display areas 501-504 may include icons associated with registered devices or applications, such that activation of buttons 511-514 are associated with changing the display to commands specific to the selected device or application.

Figure 5B:
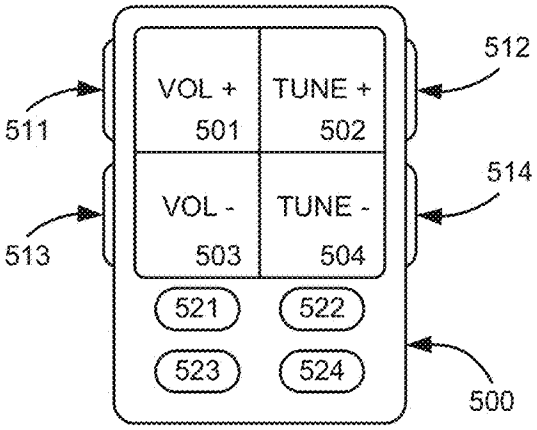

As shown in FIG. 5B, once a device/application is selected (e.g. by pressing the button 511), in this case an A/V device/application, the display of controller 500 may be changed to a second page including indicia of volume and tuning commands, and how manipulation of the buttons 511-514 will affect the volume, tuning or other setting (e.g. volume +/−, tuning +/−, etc.). In some examples, the display of certain information may be changed based on information (e.g. third command codes) received from the control configuration and command unit. For example, an actual volume setting (or tuned A/V channel, audio track, program information, etc.) may be communicated back to the controller 500 via updated page display information.

Figure 5C:
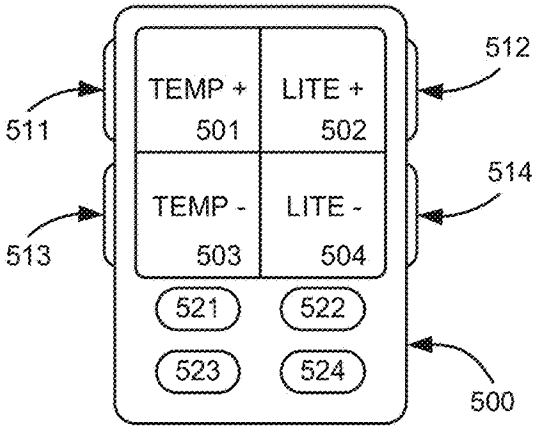

After a predetermined period of time, or other command or setting, the controller 500 may reset the display to that shown in 5A, again allowing selection of devices/applications. As shown in FIG. 5C, selection of another device/application may bring up a third display page with indicia related to temperature and/or lighting levels in a specific room. In this case, pressing any of buttons 511-514 cause certain command codes that are the same as those used in FIGS. 5A and 5B to be combined with a new page identifier that allows a hub to interpret the specific command that is intended. For example, a fixed command for button 511 in FIG. 5B is added to a "page 2" command code that the hub interprets as "volume up" for a first device/application, whereas a button 511 command in FIG. 5C is added to a "page 3" command code that the hub interprets as "temperature up" for a second device/application.

Figure 5D:
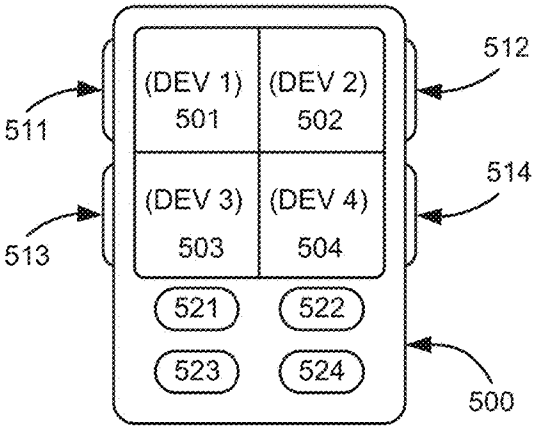

After a predetermined period of time, or other command or setting, the controller 500 may reset the display to that shown in 5A, again allowing selection of devices/applications. As shown in FIG. 5D, selection of button 514 may bring up a fourth display page with indicia related to various applications that may be accessible via the hub. In this case, selecting any of buttons 511-514 may initiate an application DEV 1-DEV 4, which may be controlled using navigation buttons 521-524 and/or via another command page presented on controller 500.

Display regions 501-504 may include various control icons specific to a selected device, e.g. DVD player etc. Such icons may be based on predetermined criteria related to the type of device, and/or may include operations specifically determined for the device model, manufacturer, etc. For example, the control system may have pre-loaded commands for commonly used devices, and/or specific makes and models of devices, and/or may be configured to receive or access device command information as needed for detected or input devices. Such updates may be performed, for example, upon detecting an external device or based on a user adding an external device to be controlled. The display or other device may dynamically determine what commands are to be displayed, as described in more detail below. Once a particular device is selected for control, various icons, such as "Replay", "Rewind", "Play", "Forward" and "Skip" for instructing DVD functions, may be provided.

The control configuration and command unit 110 may also be aware of the current state of the external devices in use, and may change display of the simple remote such as an icon representing a function state, in order to, for example, minimize the need for navigation of the UI. For example, if a live TV broadcast is paused by the user (such as by a digital video recorder (DVR)) via a command, the display may automatically highlight for activation the "Play" command icon and thus avoid the user having to manually navigate the menu of DVR commands. As another example, if a user has opted to mute an external device such as an AVR, an icon presented on the TV, such as a volume icon, may be changed to indicate that the AVR device is indeed muted. In embodiments, such changes may be based, for example, on two-way communication between the control configuration and command unit 110 and the external device, such as by HDMI, that allows the control configuration and command unit 110 to confirm that certain commands have been executed.

The user may also select buttons 511-514 in FIG. 5D to switch between "Activities." Activity icons may be presented in display areas 501-504 such as "Watch TV", "Watch Movie," "Listen to Music", and "Play Game". These icons may be dynamically displayed according to, for example, specific devices and/or applications that have been detected by control configuration and command unit 110 and configured for control via the simple controller 500.

In embodiments, the control configuration and command unit 110 may be configured such that the selection of an activity associated with particular devices may send commands to one or more devices under control, e.g. to turn on and/or adjust settings of the device(s) associated with the activity, etc. By way of further example, selecting a "Watch Movie" icon on the simple controller 500 may cause the control configuration and command unit 110 to turn on a movie source device or application, such as a DVD player, adjust sound setting of the AVR and the like, dim home lighting, and adjust the brightness of the display device.

The control configuration and command unit 110 (or controller 500) may also be configured such that the selection of an activity icon switches the display of the controller 500 to a device control display, displaying a tailored group of controllable device and/or application icons relevant to the selected activity. For example, selecting a "Watch Movie" icon may bring up a display with all available devices and/or applications that the display device can control with the ability to feed movies to the display device, as well as any other devices that may be relevant to movie watching, e.g. home lighting etc. Other configurations are also possible, such as drop down menus and the like, for selecting a desired device under a particular activity icon.

In embodiments, the controller 500 may also present a screen for application selections, such as web-based and/or computer-operated applications. Display areas 501-504 may include various application initiation icons, such as, for example, web browsers, specific web sites, web streaming services, etc. Accordingly, the display presented on controller 500 may enable a user to, for example, interact with social networks, or other web-based applications, and the like, while continuing to view content on the display. For example, a selectable icon may be interpreted by the control configuration and command unit 110 to open chat windows and the like in a portion of another screen. In embodiments, the applications opened may be automatically informed of content-related information, such as, for example, details of a show being watched on the screen which may in turn be used to guide the user to a desirable social network and/or online chat discussion.

Additional features that may be incorporated in controller 500 (or 300) may include instructions for proprietary or standardized wireless communication (or a combination of low energy wireless communication protocols) with the hub, such as control configuration and command unit 110.

Controller 500 may include, for example, a 1.26 or 1.28 inch display, or variation of the display, which may be an "always on" with black and white bi-stable LCD. Other display options may also be possible, e.g. depending on capacity of the battery or other power sources.

In some examples, LCD with back or front lighting may be included. Front or backlighting may be triggered with either a glow button and/or a combination proximity and ambient light sensor (only turning on front or back lighting if ambient light sensor is indicating a dim/dark room and proximity sensor detects the intent of the customer to light the LCD).

In some examples, the controller 500 may be configured to "wake up" based on various events, such as control events and environmental events. A control event (e.g. button, touch, gesture) may be sent to the hub, e.g. as an event request. The hub may process the event and send an event response back to the simple remote in the form of second command codes that configure the simple remote for the event. Based on event processing result, if an image/display on the simple remote needs to be updated, image data or image index may be included in the event response.

An environmental event (e.g. using proximity, sound and/or light sensor) can also be used to wake up the simple remote. In some examples, an initial event may prompt additional analysis before fully activating the simple remote or activating lighting or other functions (e.g. the simple remote may check level of ambient light sensor to determine if turning on backlight or front light is needed).

In some examples, the simple remote may be configured to only be woken up by specific events, and may be configured to return to sleep mode as soon as the event is processed completely.

In some examples, the simple remote may include a proximity sensor and/or ALS, and may include logic that ensures that certain functions, such as an LCD backlight or front light, are only activated when predetermined criteria are met.

In some examples, the simple controller may also be used as an RF beacon, e.g. by detecting relatively short range transmissions from the controller in a limited area.

In some examples, the control configuration and command unit 110 may be configured to provide various updates to the simple controller, which may be related to processed commands/activities. For example, pressing a button on the simple remote may be used in coordination with an application accessed via the hub to order a pizza. The simple remote may then wake up on a schedule to check on the status of the order by interacting with the control configuration and command unit 110. If a new status of the order is determined by the control configuration and command unit 110, new display data can be sent to the simple remote e.g. to display the status of the order (in this pizza example a numerical countdown could be displayed to show how long until the pizza arrives, etc.).

Another option for output included in the third command codes to the simple remote could include audio or "voice output." An example of this could include instructions for detecting that a command is about to be received (e.g. by the proximity sensor) and announcing the command that is about to be entered, such as "you are about to order a pizza" etc. After pressing the button, or after the command code is received by the hub, the simple remote may process instructions to announce that the command has been received and/or processed, e.g. "you have just ordered a pizza."

Figure 6:
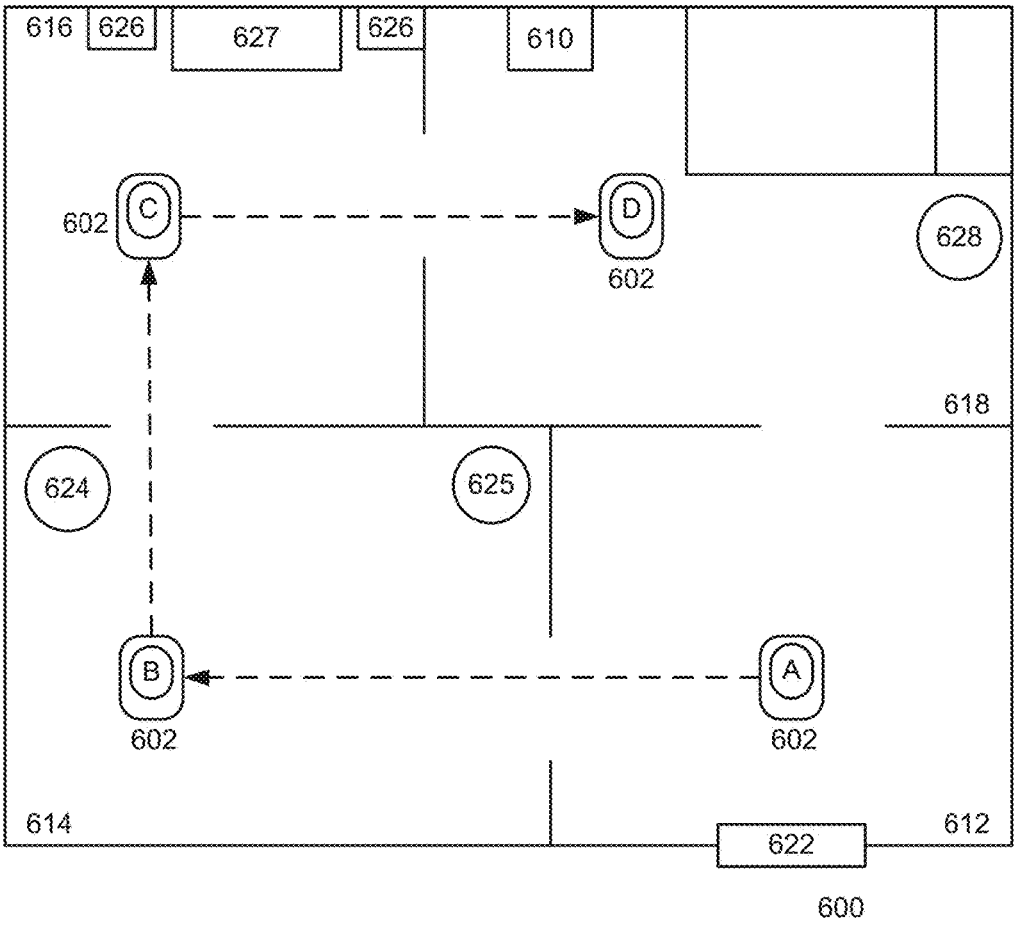
FIG. 6 depicts an environment in which the display of an example remote control device may be updated based on location in accordance with at least one embodiment.

FIG. 6 shows an illustrative environment in which the state of a simple controller may be changed based on changes in location within a home or other environment. In the example shown in FIG. 6, a controller 602 moves from room 612, to room 614, to room 616 to room 618. As discussed previously, the display of controller 602 may be based on instructions received from a hub, such as hub 625, that communicates wirelessly with the remote 602 and provides display screen information. The location of remote 602 can be localized within the home 600 by various techniques, such as beacon, relatively-near filed communication, etc. The hub 625 may be configured with information about various devices in the different rooms, such as door lock 622, lamp 624, TV 627 and speakers 626, A/V unit 610 and lamp 628. As the remote 602 is detected in or near room 612, display page information related to locking/unlocking door may be provided to remote 602 for display A. In some examples, the display A may be stored on the remote 602 and activated at the appropriate time. In other situations, the display information may be provided by the hub 625 as needed.

As the remote 602 is detected in or near room 614, display page information related to activating and/or dimming light 624 may be provided to remote 602 for display B. In some examples, the display B may be stored on the remote 602 and activated at the appropriate time. In other situations, the display information may be provided by the hub 625 as needed, and may be based on a finite memory of the remote 602 cycling between active display pages.

As the remote 602 is detected in or near room 616, display page information related to activating and/or controlling TV 627 and speakers 626, and/or associated activities, may be provided to remote 602 for display C (which can include a plurality of display pages). In some examples, the display C (or pages of the display) may be stored on the remote 602 and activated at the appropriate time. In other situations, the display information may be provided by the hub 625 as needed, and may be based on a finite memory of the remote 602 cycling between active display pages.

As the remote 602 is detected in or near room 618, display page information related to activating and/or controlling A/V unit 610 and lamp 628 and/or associated applications or activities, may be provided to remote 602 for display D (which can include a plurality of display pages). In some examples, the display D (or pages of the display) may be stored on the remote 602 and activated at the appropriate time. In other situations, the display information may be provided by the hub 625 as needed, and may be based on a finite memory of the remote 602 cycling between active display pages.

In some examples, any number of the registered devices may be controlled in combined activities as configured by the hub 625, such as turning all devices in a room off together for a "sleep" activity. The hub 625 may also adjust the display pages provided to the remote 622 based on state information associated with the various devices, and other sensors, etc. For example, a display page for a thermostat may be modified based on a detected interior temperature, a detected exterior temperature, a temperature setting, etc. In some examples, multiple remotes may also be updated based on commands received/implemented by hub 625, such as when multiple simple controllers are available to control the same device(s).

Figure 7:
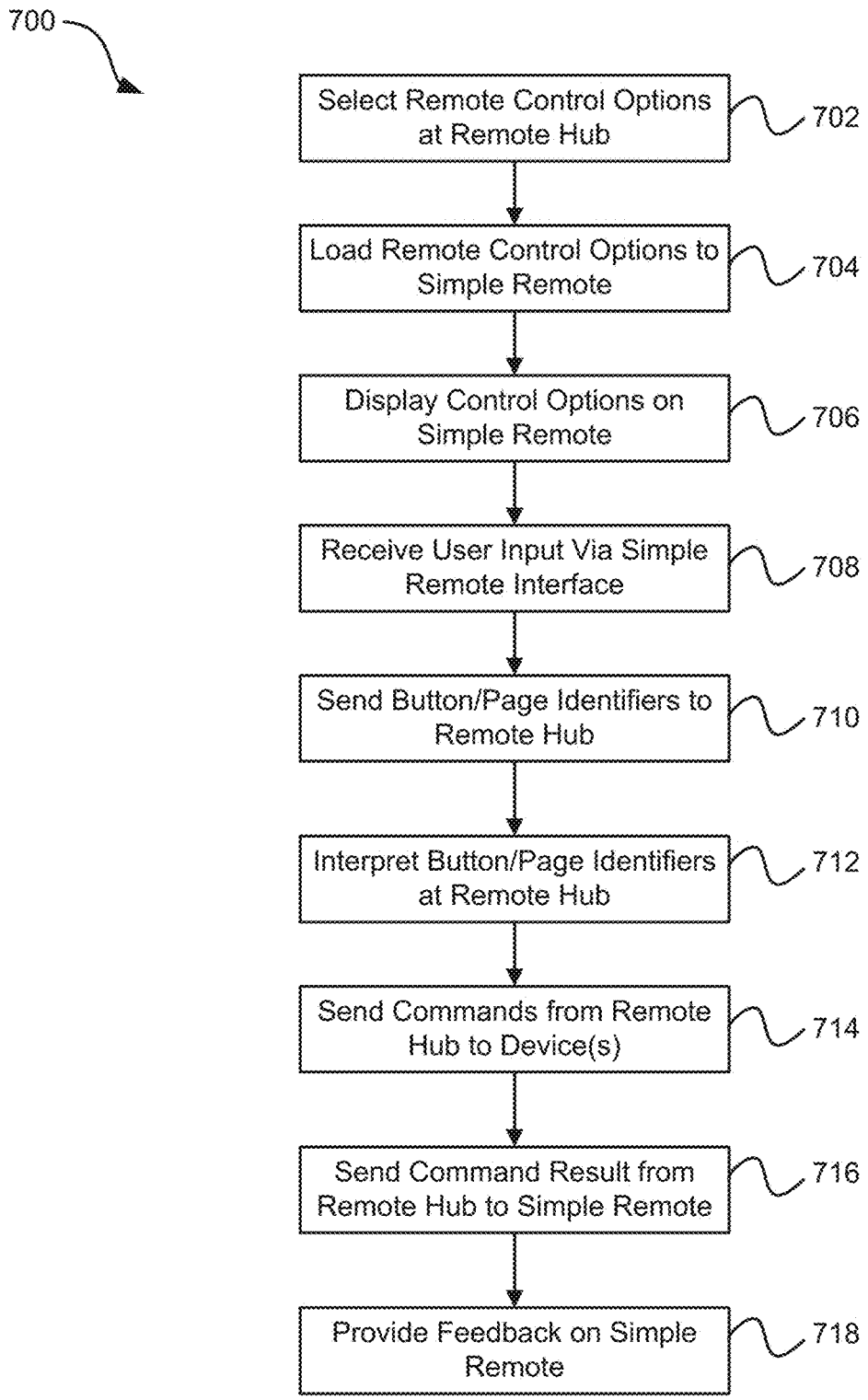
FIG. 7 shows a process for providing commands from a simplified remote control in accordance with at least one embodiment.

FIG. 7 shows an illustrative example of a process 700 for providing a simplified controller interface, in accordance with an embodiment. The term interface may indicate a combination of reconfigurable display and fixed function inputs, such as described above. Some or all of the process 700 (or any other processes described herein, or variations and/or combinations thereof) may be performed under the control of one or more computer systems configured with executable instructions and may be implemented as code (e.g., executable instructions, one or more computer programs, or one or more applications) executing collectively on one or more processors, by hardware, or combinations thereof. One or more of the actions depicted in FIG. 7 may be performed by a hub, such as the control configuration and command unit 110, and/or a simple remote, such as the remotes 300 and 500, described above.

Further, some or all of the process 700 may be performed collectively by multiple devices, such as a bridge and a display device as described in application Ser. No. 13/077,750, entitled "Apparatus and Method for Configuration and Operation of a Remote-Control System" filed on Mar. 31, 2011, which is incorporated herein by reference for all purposes.

The code may be stored on a computer-readable storage medium, for example, in the form of a computer program comprising a plurality of instructions executable by one or more processors. The computer-readable storage medium may be non-transitory.

In various embodiments, the process 700 includes selecting remote control options at a remote hub. This may include, for example, selecting registered devices and/or applications that will be controlled by the simple controller(s), and/or commands for registered devices and/or applications that will be displayed on the simple controller(s). The hub may also build associated data tables that correlate the fixed functions of the simple remote and/or display page information with commands for registered devices, applications, etc.

In various embodiments, first command codes may be sent from the hub to the simple remote in 704 in order to configure the simple remote with the selected command display pages. This may include actual display information and/or references to pre-loaded display objects on the simple remote.

In various embodiments, the simple remote may display control options in 706 based on the first command codes. Such displays may include multiple pages of command displays as previously discussed.

In various embodiments, user input may be received in 708 via the simple remote. This may include receiving input to fixed function buttons, dials, etc. as discussed previously.

In various embodiments, button and/or page information may be sent from the simple remote to the hub in 710. This may include, for example, the user input being combined with page information and sent to the hub in second command codes.

In various embodiments, the button and/or page information may be interpreted by the hub in 712. This may include identifying the intended commands based on lookup tables stored in 702, or other techniques described herein.

In various embodiments, commands identified in 712 may be sent from the hub to registered devices, applications, etc. in 714.

In various embodiments, command results may be sent from the hub in 716 to the simple remote(s). This may include, for example, determining relevant state changes and/or confirmation from registered devices that commands have been executed. These may be sent in third command codes as discussed herein and may include modified display page information operative to change the appearance of displayed pages on the simple remote.

In various embodiments, the command results from 716 may be displayed or otherwise provided on the simple remote in 718. This may include, for example, modifying display page information or other types of feedback.

Figure 8:
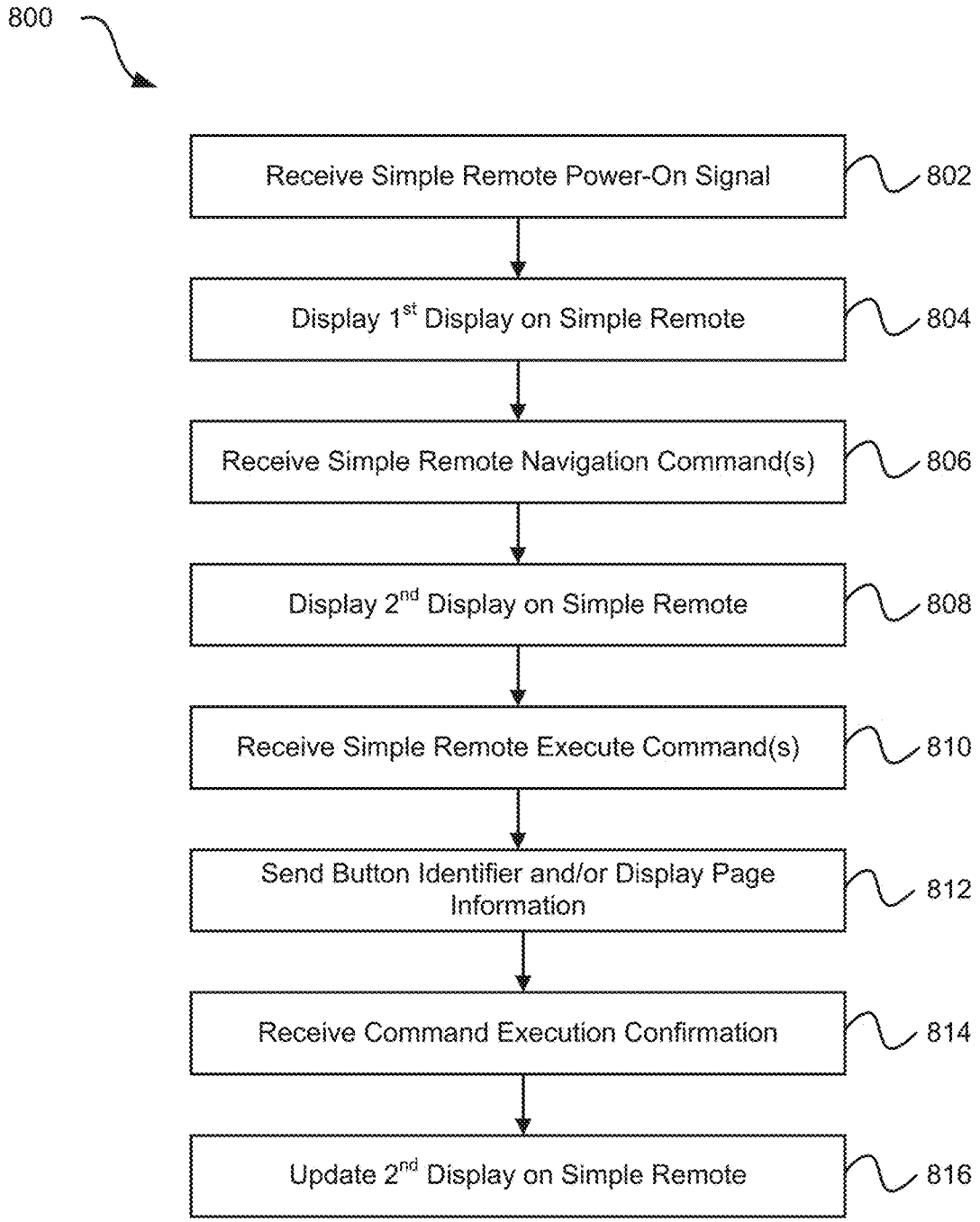
FIG. 8 shows a process for updating a display of a simplified remote control in accordance with at least one embodiment.

FIG. 8 shows an illustrative example of a process 800 for changing a simplified controller interface, in accordance with an embodiment. Some or all of the process 800 (or any other processes described herein, or variations and/or combinations thereof) may be performed under the control of one or more computer systems configured with executable instructions and may be implemented as code (e.g., executable instructions, one or more computer programs, or one or more applications) executing collectively on one or more processors, by hardware, or combinations thereof. One or more of the actions depicted in FIG. 8 may be performed by a hub, such as the control configuration and command unit 110, and/or a simple remote, such as the remotes 300 and 500, described above.

The code may be stored on a computer-readable storage medium, for example, in the form of a computer program comprising a plurality of instructions executable by one or more processors. The computer-readable storage medium may be non-transitory.

In various embodiments, the process 800 includes receiving a simple remote power on signal in 802, which may be provided by a fixed function button or sensor onboard the simple remote.

In various embodiments, a first display may be read from memory or provided by a hub for display on the remote in 804.

In various embodiments, user navigation input may be received in 806 via the simple remote. This may include receiving input to fixed function buttons, dials, etc. as discussed previously.

In various embodiments, the navigation command from 806 may be interpreted and a second display page may be presented in 808. This may be performed independently by the simple remote, e.g. in the case where multiple pages are stored on the remote, or may include sending the navigation command to the hub and receiving new page display information from the hub.

In various embodiments, user execute command input may be received in 810 via the simple remote. This may include receiving input to fixed function buttons, dials, etc. as discussed previously.

In various embodiments, the user execute command input from 810 may be sent from the simple remote to the hub. This may include sending only fixed function information, e.g. in the case where the hub updates every display page, or sending navigation information and the fixed function command information, e.g. in the case where more than one page of display information is stored on the simple remote.

In various embodiments, command results/confirmation may be received from the hub in 814 by the simple remote(s). These may be received in third command codes as discussed herein and may include modified display page information operative to change the appearance of displayed pages on the simple remote.

In various embodiments, the command results/confirmation from 814 may be displayed or otherwise provided on the simple remote in 816. This may include, for example, modifying display page information or other types of feedback.

Figure 9:
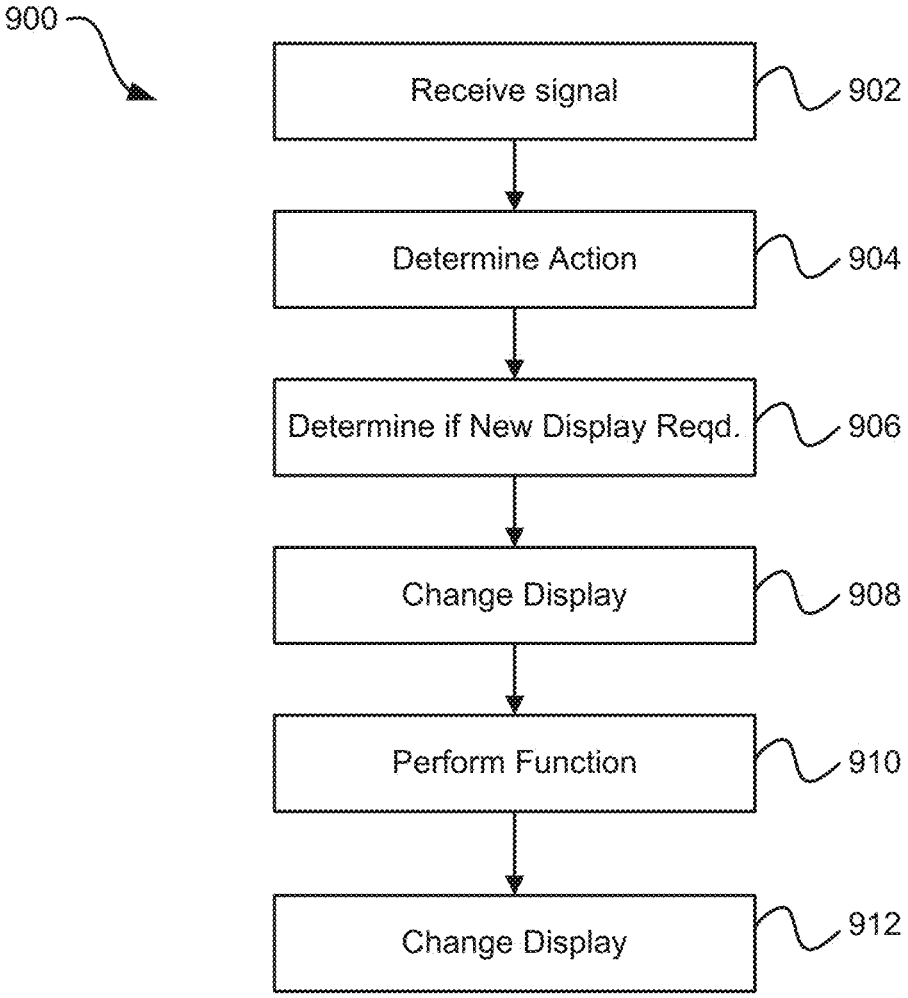
FIG. 9 shows a process for interpreting commands and updating a display of a simplified remote control in accordance with at least one embodiment.

FIG. 9 shows an illustrative example of a process 900 that may be used to update a menu that has presented to a user on a display, such as described above. For example, in an embodiment, the process 900 may be combined with the processes 700 or 800 described above in connection with FIGS. 7 and 8 when a signal is received in connection with a displayed menu. In an embodiment, the process 900 includes receiving 902 a signal, such as described above. A determination may be made 904 regarding an action to which the signal corresponds. For example, in this illustrative example, a determination is made 904 regarding whether the signal corresponds to navigation of the menu or selection of a function. If it is determined that the signal corresponds to navigation of the menu, another determination may be made 906 whether a new menu view should be presented, where a new menu view may be, for example, a new display, such as described above. As just one example, referring to the illustrative example in FIGS. 4A-4D, if it was determined that the user selected device A in 4A, such as by pressing the controller, it may be determined that a device control display should replace the current displayed. If, however, it is determined, for example, that the signal corresponds to navigation from the device A icon to the device B icon, it may be determined that a new display is not required.

Accordingly, in an embodiment, if it is determined 906 that a new display view is required, a new display may be presented 908 on the display, as discussed previously.

If it is determined in 906 that a new menu view is not required, the currently displayed menu view may simply be updated, such as by highlighting a new menu option. Further, if the received signal did not correspond to anything that would require update of the menu view (or a new menu view), the current menu view may be left unchanged.

If it was determined 904 that the signal corresponds to a function to be performed (such as if the user selected a menu option), then, in an embodiment, the function may be performed 910. If a device performing some or all of the process 900 is to perform the function, the device may perform the function itself. If a different device is to perform the function, a signal may be sent to the device to instruct the device to perform the function. As an illustrative example, if a simple remote is performing the process 900 and the signal corresponds to a function that the simple remote performs (such as initiating synchronization with the hub), the simple remote may perform the function. If, however, the hub is performing the process 900 and the function corresponds to another device/application function (such as pause of DVD playback), a signal may be sent from the hub to the DVD player to cause the DVD player to perform the function. The signal may be sent in any suitable manner, such as over an HDMI cable, wirelessly using IR or RF, or in another way.

In an embodiment, when the function is caused to be performed (or if performance of the function has at least been initiated), a determination may be made 912 whether to change the display again, e.g. to reflect the function has been completed or to change the display to include other functions. Some functions may be, for example, unlikely to require use of a menu once performance has been completed or at least initiated while it may be more convenient for some functions to leave a menu view displayed. For instance, subsequent to selection of a fast-forward option, it may be more convenient for the user to leave a menu view displayed to allow the user to resume normal playback once content has reached a desirable position without requiring the user to cause a menu view to appear again. However, subsequent to selection of an application option, it may be more convenient to remove the current menu view to allow the user to utilize the interface of an application that has launched. The correspondence may be predetermined or may be learned over time, such as based on user behavior or behavior of a collection of users.

Accordingly, if it is determined 912 to change the display, the hub may generate new display information or display commands that are sent to the simple remote in the form of third command codes discussed herein. Alternatively, the simple remote may include limited logic that allows for the changing of certain display pages, which can be implemented to change the display in 912.

Further, embodiments of the present disclosure also allow for menu customization by a user. For instance, a setup process may be invoked (either initially or at some later time) to allow a user to customize UI presentations. During such a setup process, the user may be able to change the order of groups and commands in a device menu or the order of commands within a menu. The same could be done from a settings menu. The order of command within a group may be ordered alphabetically by default, or based on the most common order in the population of users (crowd sourcing), and the like. The order of commands within a group and/or he order of groups & commands within a menu may be optimized automatically based on the usage tracking of a specific user, in order to minimize travel when navigating the UI. At various time, the user may be able add a currently watched television channel or other content source indicators to a maintained list of favorites by pressing and holding a dedicated menu button on his/her remote control device, or by taking some other action. At various times, the user may be able to add a URL of a currently viewed web page to a list of shortcuts by pressing and holding the dedicated menu button on his/her remote. At various times the user may be able to add the application (currently in focus or running) to the list of shortcuts by pressing and holding the dedicated menu button on his/her remote. Other variations in addition to those explicitly described herein are also considered as being within the scope of the present disclosure.

In addition, embodiments of the present invention further include computer-readable storage media that include program instructions for performing various computer-implemented operations as described herein. The computer readable medium is any data storage device that can store data which can thereafter be read by a electronic system. The media may also include, alone or in combination with the program instructions, data files, data structures, tables, and the like. The media and program instructions may be those specially designed and constructed for the purposes of the present subject matter, or they may be of the kind available to those having skill in the computer software arts. Examples of computer-readable storage media include magnetic media such as flash drives, hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). Examples of program instructions include both machine code, such as produced by a compiler, and files containing higher level code that may be executed by the computer using an interpreter.

The computer readable medium can also be distributed over a network coupled to electronic systems so that the computer readable code is stored and executed in a distributed fashion.

Other variations include, but are not limited to, variations on the hardware used to implement various embodiments of the present disclosure. For example, as discussed above, a bridge device may be used to receive signals from a remote control device based on user interaction with the remote control device and transmit signals to one or more other consumer electronic devices accordingly. Bridge devices may be configured in numerous ways. For example, in various embodiments, a bridge device has a single video input and a single video output to a display device. In this embodiment, the bridge device may receive a video signal through the video input and output a video signal accordingly. Instead of the display device overlaying menus on the display, the bridge device may modify the video signal to cause the display device to display menus generated in accordance with various embodiments. In this manner, the display device does not require computing logic for generating and displaying menus other than to decode the incoming video signal. As another example, the bridge device may include multiple video inputs and one or more video outputs. The bridge device may select from the inputs for receipt of a corresponding incoming video signal. Selection of the input may be made according to user input with a remote control device. For example, if a user selects a "Watch DVD" activity using a remote control device, the bridge device may select an input that receives a signal from a DVD player. A outgoing video signal may be sent to a display device accordingly and the outgoing video signal may be modified to overlay various menus on the display.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A remote control system, comprising a control configuration and command unit, and at least one simplified remote control, the control configuration and command unit including:

a device selection interface configured to allow a user to designate one or more devices to be controlled via the control configuration and command unit;

a remote control configuration interface configured to allow a user to select remote control options for the at least one simplified remote control, wherein the remote control options include display instructions for the at least one simplified remote control and at least one set of commands for a designated device;

a communication device configured to transmit a first set of command codes to the at least one simplified remote control in order to implement the selected remote control options on the simplified remote control, and to receive a second set of command codes from the at least one simplified remote control; and a processor configured to associate the second set of command codes with the at least one set of commands and to generate signals for controlling the designated device based at least in part on the association of the second set of command codes and the at least one set of commands, and the at least one simplified remote control including:

a reconfigurable input device including a display that changes based at least in part on the first set of command codes;

a communication device configured to receive the first set of command codes from the control configuration and command unit, and to transmit the second set of command codes to the control configuration and command unit;

a processor configured to generate the second set of command codes;

wherein the reconfigurable input device includes a plurality of buttons and a plurality of display pages, the second set of command codes includes indicia of a selected button and currently displayed display page, and the control configuration and command unit identifies at least one command for the designated device based on the indicia of the selected button and currently displayed display page.

2. A The remote control system of claim 1, wherein the processor is configured to generate the second set of command codes based on at least one of static button identification information, or a combination of static button identification information and page identifier information.

3. The remote control system of claim 1, wherein the remote control is configured to communicate only with the control configuration and command unit, and not any of the designated devices being controlled.

4. The remote control system of claim 1, wherein the remote control system is configured to allow control of the designated device via the remote control without any control codes that are recognizable by the designated device being stored on the remote control.

5. The remote control system of claim 1, wherein:

the control configuration and command unit is further configured to generate a third set of command codes including indicia that the second set of command codes has been implemented, and to send the third set of command codes to the remote control, and the remote control is configured to receive the third set of command codes and to provide feedback to a user of the remote control based at least in part on the received third set of command codes.

6. The remote control system of claim 1, wherein the indicia of the currently displayed display page includes at least one of a page identifier or a series of navigation commands.

7. The remote control system of claim 1, wherein the second set of command codes includes only static button identification information.

8. The remote control system of claim 7, wherein the control configuration and command unit is configured to determine a command based at least in part on a series of static button inputs.

9. A remote control system, comprising a control configuration and command unit, and at least one simplified remote control, the control configuration and command unit including:

a device selection interface configured to allow a user to designate one or more devices to be controlled via the control configuration and command unit;

a remote control configuration interface configured to allow a user to select remote control options for the at least one simplified remote control, wherein the remote control options include display instructions for the at least one simplified remote control and at least one set of commands for a designated device;

a communication device configured to transmit a first set of command codes to the at least one simplified remote control in order to implement the selected remote control options on the simplified remote control, and to receive a second set of command codes from the at least one simplified remote control; and a processor configured to associate the second set of command codes with the at least one set of commands and to generate signals for controlling the designated device based at least in part on the association of the second set of command codes and the at least one set of commands, and the at least one simplified remote control including:

a reconfigurable input device including a display that changes based at least in part on the first set of command codes;

a communication device configured to receive the first set of command codes from the control configuration and command unit, and to transmit the second set of command codes to the control configuration and command unit;

a processor configured to generate the second set of command codes based on at least one of static button identification information, or a combination of static button identification information and page identifier information;

wherein:

the control configuration and command unit is configured to send display information for a plurality of display pages to the at least one simplified remote control; and the at least one simplified remote control is configured to separately display each of the plurality of display pages, and to include indicia of a selected button and currently displayed display page in the second set of command codes.

* * * * *